US011844413B2

(12) United States Patent
Yan et al.

(10) Patent No.: US 11,844,413 B2
(45) Date of Patent: Dec. 19, 2023

(54) PACKAGING CONTAINER

(71) Applicant: UDN PACKAGING CORP, Shenzhen (CN)

(72) Inventors: Jiajun Yan, Shenzhen (CN); Nanchieh Wang, Shenzhen (CN)

(73) Assignee: UDN PACKAGING CORP, Shenzhen (CN)

( * ) Notice: Subject to any disclaimer, the term of this patent is extended or adjusted under 35 U.S.C. 154(b) by 44 days.

(21) Appl. No.: 17/625,005

(22) PCT Filed: Jul. 16, 2019

(86) PCT No.: PCT/CN2019/096170
§ 371 (c)(1),
(2) Date: Jan. 5, 2022

(87) PCT Pub. No.: WO2021/007777
PCT Pub. Date: Jan. 21, 2021

(65) Prior Publication Data
US 2022/0287434 A1 Sep. 15, 2022

(51) Int. Cl.
*A45D 34/04* (2006.01)
*A45D 40/26* (2006.01)

(52) U.S. Cl.
CPC ..... *A45D 34/041* (2013.01); *A45D 40/261* (2013.01)

(58) Field of Classification Search
CPC .... A45D 34/041; A45D 40/261; B05C 17/02; B05C 17/0217; B05C 17/022; B05C 17/0242; B05C 17/025; B05C 17/03
USPC ..... 401/208–216
See application file for complete search history.

(56) References Cited

U.S. PATENT DOCUMENTS 2,700,784 A 2/1955 De Brock
2,823,403 A 2/1958 Whitney
2,937,391 A 5/1960 Phillipps
3,284,839 A * 11/1966 Cook ..... A45D 34/041 401/208
4,648,732 A * 3/1987 Smialkowski ..... B65D 47/42 401/196
6,546,588 B1 * 4/2003 Black ..... A47K 7/028 15/244.1

(Continued)

FOREIGN PATENT DOCUMENTS

CN 1644130 A 7/2005
CN 2764214 Y 3/2006

(Continued)

OTHER PUBLICATIONS

The World Intellectual Property Organization (WIPO) International Search Report for PCT/CN2019/096170 dated Apr. 20, 2020 6 Pages (with translation).

*Primary Examiner* — David J Walczak
(74) *Attorney, Agent, or Firm* — ANOVA LAW GROUP, PLLC

(57) ABSTRACT

A packaging container includes a tube body, a tube head, a roller applicator, and a cover. The tube head is connected to one end of the tube body, and the roller applicator is arranged on the tube head. When not in use, the cover may cover the tube head, and the blocking portion of the cover seals an orifice of the tube head to prevent inner material from leaking. When in use, the contact area between the roller applicator and the skin may reach more than 65%, which provides an improved massage effect.

18 Claims, 6 Drawing Sheets

(56) References Cited

U.S. PATENT DOCUMENTS

| | | | | |
|---|---|---|---|---|
| 8,602,671 | B2 * | 12/2013 | Kim | A45D 34/041 401/219 |
| 9,999,287 | B2 * | 6/2018 | Cheng | B65D 47/42 |

FOREIGN PATENT DOCUMENTS

| | | | |
|---|---|---|---|
| KR | 20090002433 | U | 3/2009 |
| WO | 2006090061 | A1 | 8/2006 |
| WO | 2010017678 | A1 | 2/2010 |

* cited by examiner

PACKAGING CONTAINER

CROSS-REFERENCE TO RELATED APPLICATION

This application is a national phase entry under 35 U.S.C § 371 of International Application No. PCT/CN2019/096170, filed on Jul. 16, 2019, the entire content of which is incorporated herein by reference.

TECHNICAL FIELD

The present invention relates to the technical field of packaging containers and, in particular, relates to packaging containers.

TECHNICAL BACKGROUND

Ball containers have been used for a long time, such as U.S. Pat. Nos. 2,700,784, 2,823,403, and 2,937,391. The ball containers proposed by these patents are all equipped with balls on the liquid outlet of the container. When the cover is locked, the balls are pressed to close the liquid outlet of the container, so that inner material of the container will not leak. When the cover is opened, the container is turned upside down, and the ball touches the skin, the inner material brought out when the ball is rolled can be evenly applied to the skin.

However, the ball container in the prior art has functional and use deficiencies:

1. The opening and closing of the liquid outlet of the container is to close the liquid outlet by pressing the ball against the cover. After multiple uses, the area of the liquid outlet of the container may wear out, causing liquid leakage;
2. The gap between the ball and the liquid outlet is restricted by the ball bearing seat, and the high-viscosity inner material is difficult to flow out; and
3. When in use, the user holds the roller container, the liquid outlet of the container must face down so that the ball is soaked into the inner material, and put the roller container perpendicular to the skin to apply and massage, which will hinder the user's sight in the mirror and cannot be applied to the required area accurately; moreover, the contact area of the ball with the skin during use is very small, and the contact area is less than 30% of the surface area of the entire ball.

Technical Problems

The purpose of the embodiments of the present invention is to provide a packaging container to solve the problem that the ball container in the prior art may leak after multiple uses. The high-viscosity inner material is not easy to flow out. The technical problem of facing down and difficult to apply while looking in the mirror.

SUMMARY

An embodiment of the present invention provides a packaging container, including:

a squeezable tube body;

a tube head connected to one end of the tube body;

a roller applicator mounted on the tube head; and a cover having a blocking portion. When the cover is placed on the tube head, the blocking portion seals the orifice of the tube head.

Another embodiment of the present invention provides a packaging container, including:

a squeezable tube body;

a tube head installed at one end of the tube body;

a roller applicator mounted on the tube head; and a cover with a blocking portion. When the cover is placed on the tube head, the blocking portion seals the orifice of the tube head.

The tube body and the tube head are made by individual manufacturing processes, and the tube head is mounted on the tube body.

Beneficial Effects

The tube head is connected to or installed at one end of the tube body, and a roller applicator is provided on the tube head. When in use, the cover is removed first, the tube body is squeezed to let an inner material of the tube body flow out of the tube head to the upper surface of the roller applicator, and then the roller applicator is rolled to more evenly spread the inner material on skin and make it same easier to absorb. The angle between the packaging container and the skin during application of this roller applicator is less than 60 degrees. When applying on the face, it will not be applied only by feeling [because] of the hand or container. It can be applied accurately to the area to be applied by looking in the mirror to enhance the user experience. In addition, when the roller applicator is in use, the contact area with the skin can reach more than 65 percent, which can have a better massage effect. When not in use, the cover may cover the tube head, and the blocking portion of the cover seals an orifice of the tube head to prevent inner material from leaking. In addition, the size of the orifice of the tube head can be changed and adjusted according to the viscosity of the inner material. Even if there is a high-viscosity inner material in the tube body, by changing the size of the tube head orifice, the high-viscosity inner material in the tube body can smoothly flow out to the roller. The packaging container has a wide range of adaptability to inner materials of different viscosities.

BRIEF DESCRIPTION OF THE DRAWINGS

In order to more clearly describe the technical solutions in the embodiments of the present invention, the following will briefly introduce the embodiments or the accompanying drawings that need to be used in the description of the prior art. Obviously, the accompanying drawings in the following description are merely for some of the embodiments of the present invention, for those of ordinary skill in the art, other drawings may be obtained based on these drawings without creative labor.

EMBODIMENTS OF DETAILED DESCRIPTION OF THE INVENTION

Figure 1:
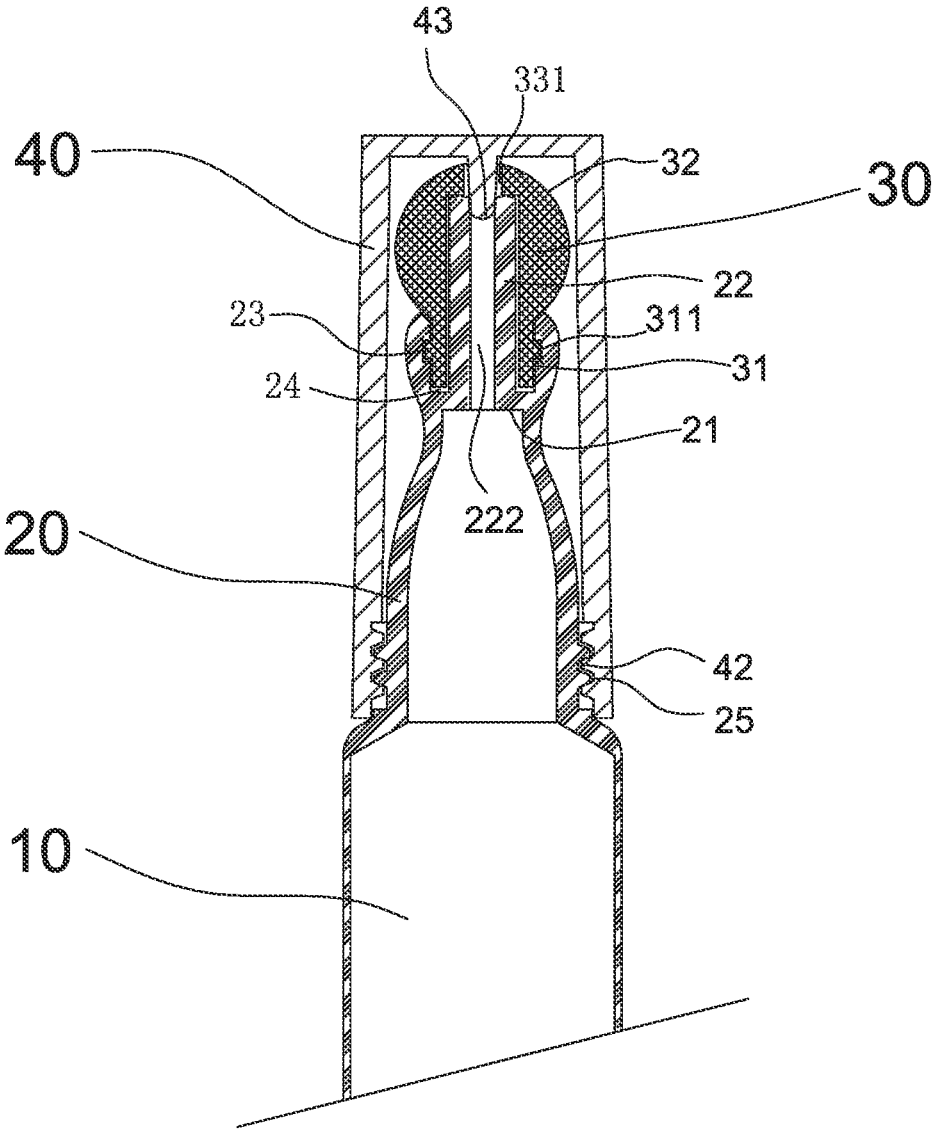
FIG. 1 is a cross-sectional view of a packaging container provided by an embodiment of the present invention.

In order to make the technical problems, technical solutions and beneficial effects to be solved by the present invention clearer, the following further describes the present invention in detail with reference to the accompanying drawings and embodiments. It should be understood that the specific embodiments described here are only used to explain the present invention, but not used to limit the present invention.

In the description of the embodiments of the present invention, it should be understood that the terms "length", "width", "upper", "lower", "front", "rear", "left", "right", The orientation or positional relationship indicated by "vertical", "horizontal", "top", "bottom", "inner", "outer", etc. is based on the orientation or positional relationship shown in the drawings, and is only for the convenience of describing the implementation of the present invention examples and simplified descriptions do not indicate or imply that the pointed device or element must have a specific orientation, be constructed and operated in a specific orientation, and therefore cannot be understood as a limitation to the embodiments of the present invention.

In the embodiments of the present invention, unless otherwise clearly specified and limited, the terms "installed", "connected", "fixed" and other terms should be understood in a broad sense. For example, it may be a fixed connection. It can be detachably connected or integrated; it can be mechanically connected or electrically connected; it can be directly connected or indirectly connected through an intermediary, and it can be the internal communication of two components or the interaction relationship between two components. For those of ordinary skill in the art, the specific meanings of the above-mentioned terms in the embodiments of the present invention can be understood according to specific conditions.

Figure 2:
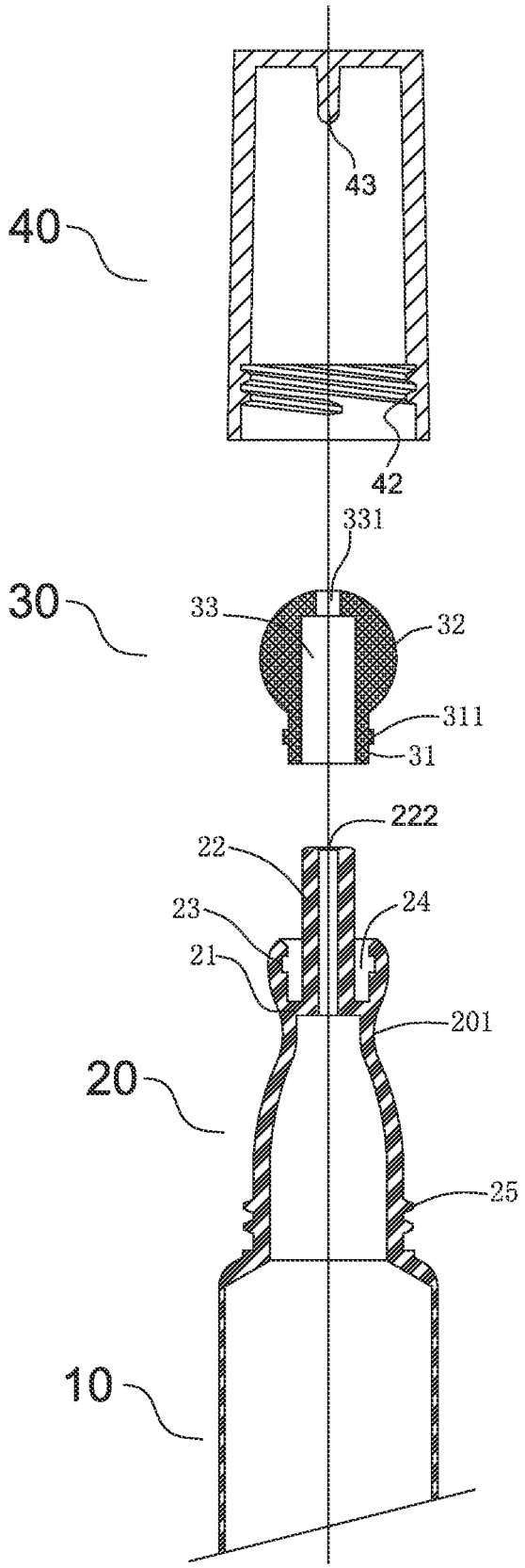
FIG. 2 is an exploded view of the packaging container of FIG. 1.

Please refer to FIGS. 1 and 2, an embodiment of the present invention provides a packaging container, which includes a tube body 10, a tube head 20, a roller applicator 30, and a cover 40. The tube head 20 is connected to one end of the tube body 10. The tube body 10 is made of soft material, so that the tube body 10 can be squeezed. The tube body 10 is used to hold the inner material, and the inner material can flow out of the tube head 20 by squeezing the tube body 10. The roller applicator 30 is installed on the tube head 20. The cover 40 has a blocking portion 43, and when the cover 40 is placed on the tube head 20, the blocking portion 43 seals the orifice 222 of the tube head 20. In one embodiment, the cover 40 is clamped or screwed to the tube body 10.

The tube head 20 is connected to one end of the tube body 10, and a roller applicator 30 is provided on the tube head 20. When in use, first the cover 40 is removed, and the tube body 10 is squeezed to let the inner material of the tube body 10 flow out to the roller applicator 30 through the tube head 20, and then roll through the roller applicator 30 to make the inner material more uniformly applied to the skin and easier to absorb. The angle between the packaging container and the skin during application of this roller applicator 30 is less than 60 degrees. It is aimed at applying on the face without being blocked by hands or containers and can only be applied by feeling. Instead, it can be applied precisely to the area to be applied by looking in the mirror to enhance the user experience. In addition, the contact area of the roller applicator 30 with the skin can reach more than sixty-five percent during use, which can have a better massage effect. When not in use, the cover 40 can be placed on the tube head 20. At this time, the blocking portion 43 of the cover 40 will seal the orifice 222 of the tube head 20 to avoid leakage of the inner material and keep the inner material in the tube body 10. In addition, the size of the orifice 222 of the tube head 20 can be changed and adjusted according to the viscosity of the internal material. Even if the tube body 10 contains a high-viscosity internal material, by changing the size of the orifice 222, the high-viscosity internal material in the tube body 10 can also be adjusted. It flows smoothly onto the roller applicator 30, and the packaging container has a wide range of adaptability to inner materials of different viscosities.

In the present invention, the tube head 20 is directly molded on the tube body 10 from flexible plastic or thermoplastic elastomer. The structure is easy to shape. Specifically, the tube body 10 is first manufactured, and then the tube head 20 is injection-molded at one end of the tube body 10, and the tube head 20 is set on the tube body 10. Wherein, the tube head 20 can also be made of flexible plastic or thermoplastic elastomer, which has certain elasticity. When the roller applicator 30 is used, the position of the neck 201 of the tube head 20 can be bent, so that the roller applicator 30 can be bent at a certain angle, which is easier to apply and can improve user experience.

Figure 3:
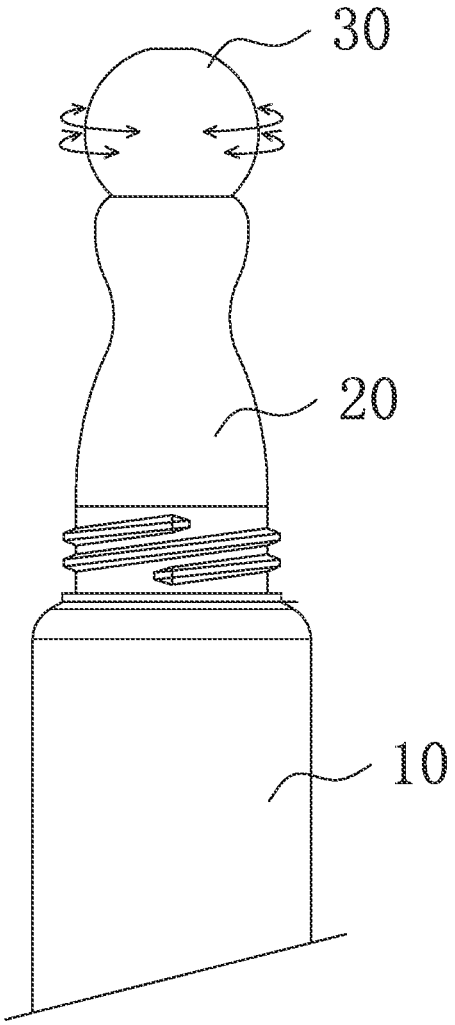
FIG. 3 is a front view of a packaging container provided by an embodiment of the present invention, where a cover is not shown.

Please refer to FIGS. 1 to 3, in the embodiment of the present invention, a bracket 21 is provided inside the tube head 20, and a tubular liquid outlet nozzle 22 is provided in the center of the bracket 21, and a slot 24 is formed by the bracket 21, an outer peripheral surface of the liquid outlet nozzle 22, and an upper portion of the tube head 20. The liquid outlet nozzle 22 is provided to facilitate the internal material to flow out of the liquid outlet nozzle 22 when the tube body 10 is squeezed. When the roller applicator 30 is installed on the liquid outlet nozzle 22 and inserted into the slot 24, the roller applicator 30 can be rolled around the axis of the liquid outlet nozzle 22, avoiding the separation of the roller applicator 30 from the tube head 20 when using the roller applicator 30 and ensuring the reliability of the structure.

Figure 4:
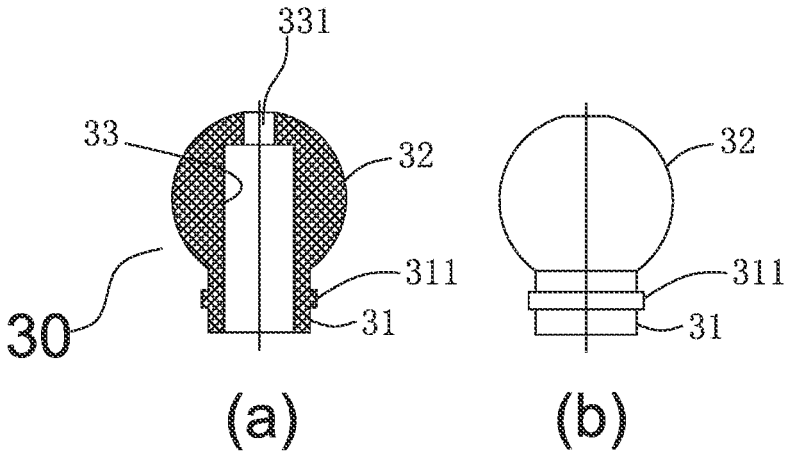
FIGS. 4(*a*) and 4(*b*) are respectively a cross-sectional view and a front view of a roller applicator used in the packaging container of FIG. 3.
Figure 5:
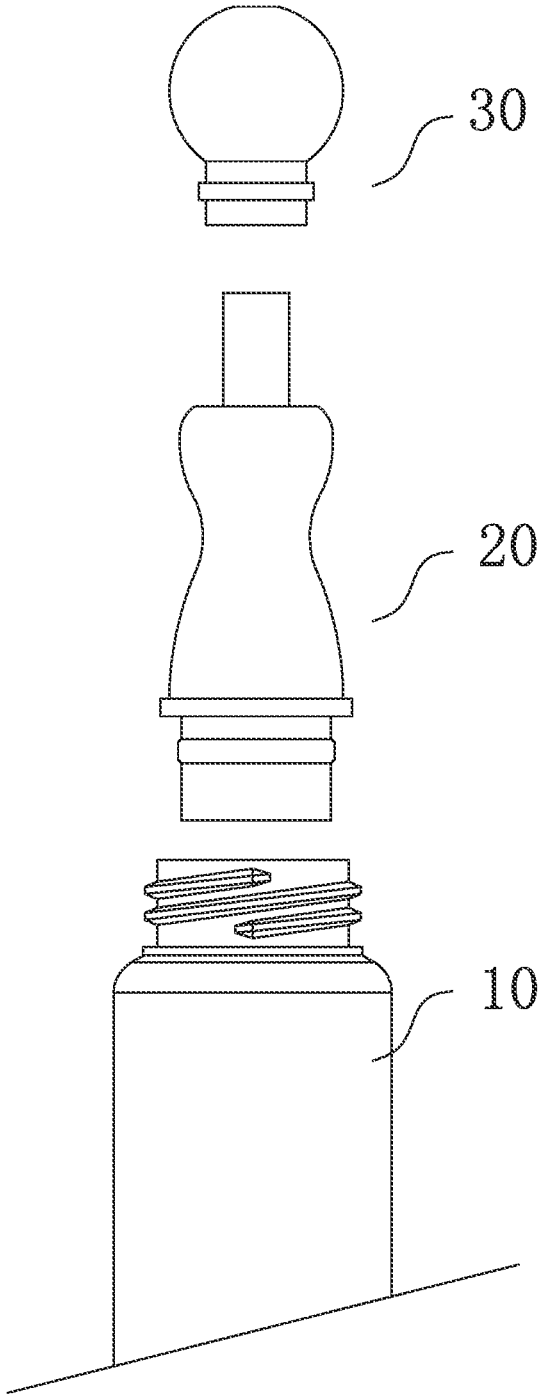
FIG. 5 is a three-dimensional exploded view of a packaging container provided by another embodiment of the present invention, in which a cover is not shown.

Please refer to FIGS. 1, 2, and 4, in the embodiment of the present invention, the roller applicator 30 includes a connecting portion 31 and an application portion 32 connected to the connecting portion 31, and when the connecting portion 31 is inserted into the slot 24 and the ring rib 311 of the connecting portion 31 is clamped in the ring groove 23 of the tube head 20, the roller applicator 30 is limited on the tube head 20 along the axial direction of the liquid outlet nozzle 22. This solution can control the roller applicator 30 to maintain a horizontal state when rolling and prevent the roller applicator 30 from falling out. Specifically, the connecting portion 31 is substantially tubular, and a ring rib 311 is provided on the connecting portion 31. When the connecting portion 31 of the roller applicator 30 is inserted into the slot 24, the ring rib 311 on the roller applicator 30 will correspondingly snap into the ring groove 23 of the tube head 20, so that the roller applicator 30 is fixedly assembled to the tube head 20, and allow the roller applicator 30 to roll around the axis of the liquid outlet nozzle 22. During the rolling process of the roller applicator 30, the roller applicator 30 will always remain in the slot 24 and will not be separated from the slot 24. When the roller applicator 30 needs to be replaced, it can be replaced by pulling the roller applicator 30 away from the tube head 20 with the same action and strength as pulling off the cover, and the installation and disassembly operations are equally easy.

In the embodiment of the present invention, the application portion 32 may be spherical, ellipsoidal, conical, polyhedral or other shapes, which are specifically set as required. The applicator portion 32 is used for contact with human skin, and the roller applicator 30 can roll freely to achieve a certain massage effect, which makes it easier for the skin to absorb internal materials and enhance the user experience.

In the embodiment of the present invention, the roller applicator 30 may be made of plastic, thermoplastic elastomer, metal, ceramic, wood, stone or other materials, according to different massage experiences that need to be set up. When the roller applicator 30 touches and rolls on the human skin, it can provide a different massage experience.

Please refer to FIGS. 1 to 3, in the embodiment of the present invention, a bracket 21 is provided inside the tube head 20, and a tubular liquid outlet nozzle 22 is provided in the center of the bracket 21, and the liquid outlet nozzle 22 passes through an end of the tube head 20 at a side away from the tube body 10. The liquid outlet nozzle 22 is connected to the inner cavity of the tube head 20, and further to the inner cavity of the tube body 10, the liquid outlet nozzle 22 extends into the channel 33 of the roller applicator 30, and the roller applicator 30 rolls around the axis of the liquid outlet nozzle 22. Specifically, the channel 33 of the roller applicator 30 penetrates the application portion 32 and the connection portion 31 and is provided. When assembling, let the liquid outlet nozzle 22 extend into the channel 33 of the roller applicator 30, so that the roller applicator 30 can roll stably around the axis of the liquid outlet nozzle 22 to provide a good rolling massage effect. When being in use, the inner material of the tube body 10 flows out to the roller applicator 30 through the tube head 20 and the liquid outlet nozzle 22, and the roller applicator 30 rolls and smears to make the inner material easier to be absorbed, and at the same time, there is a certain amount of massage to effectively enhance user experience.

In the embodiment of the present invention, the end port of the liquid outlet nozzle 22 corresponds to the outlet 331 of the channel 33 of the roller applicator 30. In use, by squeezing the tube body 10, the inner material of the tube body 10 passes through the liquid outlet nozzle 22 and flows out of the outlet 331 of the channel 33 of the roller applicator 30. When not in use, the cover 40 is covered on the tube head 20. At this time, the blocking portion 43 of the cover 40 seals the orifice 222 of the tube head 20 to avoid leakage of the inner material and keep the inner material in the tube body 10.

Figure 6:
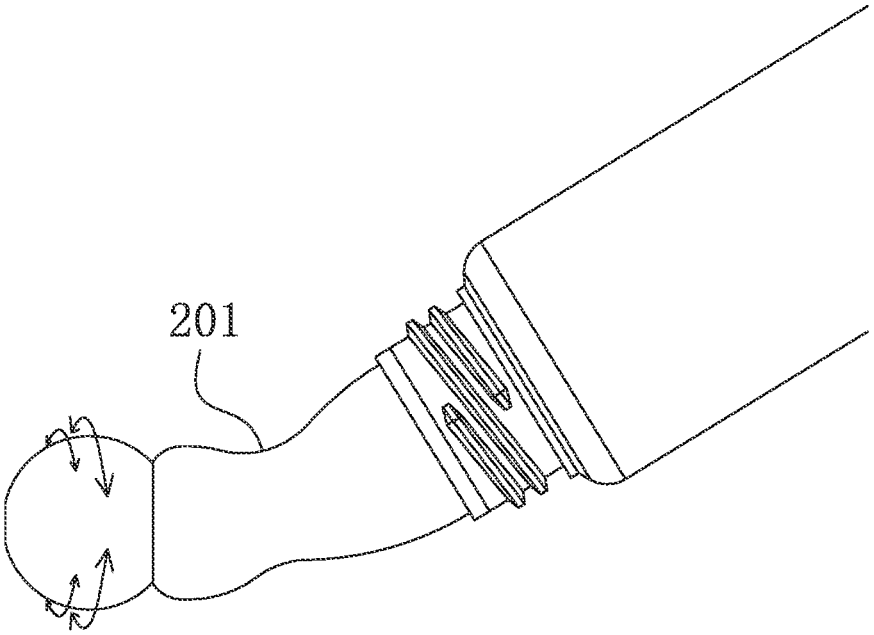
FIG. 6 is a schematic structural view of the packaging container of FIG. 5 when in use.

Please refer to FIG. 6, in an embodiment of the present invention, the tube head 20 is an elastic bendable tube head. This solution allows the roller applicator 30 to bend at a certain angle, making it easier to apply. Specifically, the tube head 20 may be made of flexible plastics or thermoplastic elastomers. These materials have elasticity and can be bent, and the tube head 20 can be easily formed.

In the embodiment of the present invention, please refer to FIGS. 1 and 2. When the cover 40 is placed on the tube head 20, a coupling device 25 is provided on the tube head 20 to engage with the corresponding coupling device 42 on the cover 40, The coupling device 25 can be a threaded fit or a bayonet connection fit, so as to realize the assembly of the cover 40 and the tube head 20.

Please refer to FIGS. 1 to 5, an embodiment of the present invention provides a packaging container, which includes a tube body 10, a tube head 20, a roller applicator 30, and a cover 40. The tube body 10 and the tube head 20 are manufactured by separate manufacturing processes, and the tube head 20 is installed at one end of the tube body 10. The tube body 10 is made of soft material, so that the tube body 10 can be squeezed. The tube body 10 is used to hold the inner material, and the inner material can flow out of the tube head 20 by squeezing the tube body 10. The roller applicator 30 is installed on the tube head 20. The cover 40 has a blocking portion 43, and when the cover 40 is placed on the tube head 20, the blocking portion 43 seals the orifice 222 of the tube head 20.

The tube head 20 is installed at one end of the tube body 10, and a roller applicator 30 is provided on the tube head 20. When in use, first the cover 40 is removed and the tube body 10 is squeezed to let the inner material of the tube body 10 flow out to the roller applicator 30 through the tube head 20, and then roll through the roller applicator 30 to make the inner material more uniformly applied to the skin and easier to absorb. The angle between the packaging container and the skin during application of this roller applicator 30 is less than 60 degrees. It is aimed at applying on the face without being blocked by hands or containers and can only be applied by feeling. Instead, it can be applied precisely to the area to be applied by looking in the mirror to enhance the user experience. In addition, the contact area of the roller applicator 30 with the skin can reach more than sixty-five percent during use, which can have a better massage effect. When not in use, the cover 40 can be placed on the tube head 20. At this time, the blocking portion 43 of the cover 40 will seal the orifice 222 of the tube head 20 to avoid leakage of the inner material and keep the inner material in the tube body. In addition, the size of the orifice 222 of the tube head 20 can be changed and adjusted according to the viscosity of the internal material. Even if the tube body 10 contains a high-viscosity internal material, by changing the size of the orifice 222, the high-viscosity internal material in the tube body 10 can also be adjusted. It flows smoothly onto the roller applicator 30, and the packaging container has a wide range of adaptability to inner materials of different viscosities.

The above are only preferred embodiments of the present invention and are not intended to limit the present invention. Any modification, equivalent replacement and improvement made within the spirit and principle of the present invention shall be included in the present invention. Within the scope of protection.

What is claimed is:

1. A packaging container, comprising:

a squeezable tube body;

a tube head connected to one end of the tube body;

a roller applicator installed on the tube head;

a cover having a blocking portion, wherein when the cover is placed on the tube head, the blocking portion of the cover directly extends into an orifice of the tube head and seals the orifice of the tube head;

a bracket is arranged inside the tube head;

a liquid outlet nozzle is arranged in a center of the bracket; and a slot is formed by the bracket, an outer peripheral surface of the liquid outlet nozzle, and an upper portion of the tube head.

2. The packaging container according to claim 1, wherein: the tube head is directly molded on the tube body from flexible plastic or thermoplastic elastomer.

3. The packaging container according to claim 1, wherein: the roller applicator includes a connecting portion and an application portion connected to the connecting portion; and when the connecting portion is inserted into the slot and a ring rib of the connecting portion is clamped on a ring groove of the tube head, the roller applicator is confined on the tube head along an axial direction of the liquid outlet nozzle.

4. The packaging container according to claim 3, wherein the application portion is spherical, ellipsoidal, conical or polyhedron.

5. The packaging container according to claim 1, wherein: the tube head is an elastic bendable tube head.

6. The packaging container according to claim 1, wherein: the cover is clamped or screwed to the tube body.

7. The packaging container according to claim 1, wherein: the roller applicator is a plastic piece, a thermoplastic elastomer piece, a metal piece, a ceramic piece, a wood piece or a stone piece.

8. The packaging container according to claim 1, wherein: the liquid outlet nozzle is set through an end of the tube head, sequentially connected with an inner cavity of each of the tube head and the tube body, and arranged to extend into a channel of the roller applicator, and the roller applicator is arranged to roll around an axis of the liquid outlet nozzle.

9. A packaging container, comprising:

a squeezable tube body;

a tube head connected to one end of the tube body;

a roller applicator installed on the tube head;

a cover having a blocking portion, wherein when the cover is placed on the tube head, the blocking portion seals an orifice of the tube head, a bracket is arranged inside the tube head, and a liquid outlet nozzle is arranged in a center of the bracket, wherein the liquid outlet nozzle is set through an end of the tube head away from the tube body, the liquid outlet nozzle is sequentially connected with an inner cavity of each of the tube head and the tube body, and the liquid outlet nozzle is arranged to extend into a channel of the roller applicator, and the roller applicator is arranged to roll around an axis of the liquid outlet nozzle.

10. The packaging container according to claim 9, wherein:

a slot is formed by the bracket, an outer peripheral surface of the liquid outlet nozzle, and an upper portion of the tube head.

11. The packaging container according to claim 10, wherein:

the roller applicator includes a connecting portion and an application portion connected to the connecting portion; and when the connecting portion is inserted into the slot and a ring rib of the connecting portion is clamped on a ring groove of the tube head, the roller applicator is confined on the tube head along an axial direction of the liquid outlet nozzle.

12. A packaging container, comprising:

a squeezable tube body;

a tube head installed at one end of the tube body;

a roller applicator installed on the tube head;

a cover with a blocking portion, wherein, when the cover is placed on the tube head, the blocking portion directly extends into an orifice of the tube head and seals the orifice of the tube head, and the tube body and the tube head are manufactured by individual manufacturing processes;

a bracket is arranged inside the tube head;

a liquid outlet nozzle is arranged in a center of the bracket; and a slot is formed by the bracket, an outer peripheral surface of the liquid outlet nozzle, and an upper portion of the tube head.

13. The packaging container according to claim 12, wherein:

the roller applicator includes a connecting portion and an application portion connected to the connecting portion; and when the connecting portion is inserted into the slot and a ring rib of the connecting portion is clamped on a ring groove of the tube head, the roller applicator is confined on the tube head along an axial direction of the liquid outlet nozzle.

14. The packaging container according to claim 12, wherein:

the liquid outlet nozzle is set through an end of the tube head, sequentially connected with an inner cavity of each of the tube head and the tube body, and arranged to extend into a channel of the roller applicator, and the roller applicator is arranged to roll around an axis of the liquid outlet nozzle.

15. The packaging container according to claim 12, wherein:

the tube head is directly molded on the tube body from flexible plastic or thermoplastic elastomer.

16. The packaging container according to claim 12, wherein:

the tube head is an elastic bendable tube head.

17. The packaging container according to claim 12, wherein:

the cover is clamped or screwed to the tube body.

18. The packaging container according to claim 12, wherein:

the roller applicator is a plastic piece, a thermoplastic elastomer piece, a metal piece, a ceramic piece, a wood piece or a stone piece.

* * * * *